United States Patent [19]

Hug

[11] 4,299,007

[45] Nov. 10, 1981

[54] VACUUM CLEANER FOR PROFESSIONAL AND HOUSEHOLD PURPOSES

[75] Inventor: Niklaus Hug, Romanshorn, Switzerland

[73] Assignee: Rommag P. Wörwag & Co., Romanshorn, Switzerland

[21] Appl. No.: 106,482

[22] Filed: Dec. 26, 1979

[30] Foreign Application Priority Data

Dec. 23, 1978 [DE] Fed. Rep. of Germany ..... 2856116

[51] Int. Cl.[3] ..... A47L 9/28

[52] U.S. Cl. ..... 15/339; 15/323; 15/327 R

[58] Field of Search ..... 15/323, 327 R, 327 D, 15/327 E, 327 F, 339

[56] References Cited

U.S. PATENT DOCUMENTS 3,588,944 6/1971 Fromknecht et al. ..... 15/323 X 3,766,594 10/1973 Westergren et al. ..... 15/327 F

*Primary Examiner*—Chris K. Moore

*Attorney, Agent, or Firm*—Becker & Becker, Inc.

[57] ABSTRACT

A vacuum cleaner for professional and household purposes, with actuating elements for introducing the individual apparatus functions, including, for instance, turning the blower motor on and off, rewinding the power supply line into the housing interior, and changing the suction capacity. The actuating elements are capable of being actuated by foot. The actuating elements are combined in the form of a pedal strip arranged in a lower part of an end face or side of the vacuum cleaner. The pedal strip is arranged below the opening for the suction hose. The pedal strip extends over the width of the side, and forms a lower edge or termination thereof. The pedal strip is located within the outer contour of the apparatus housing. A free space for introducing the foot or shoe tip is arranged above the pedal strip, and the upper surface of the pedal strip may be inclined toward the front. The pedal strip can also be a single piece, with the contacts for actuation of the various functions being arranged in the region of the outer ends, remote from each other, of the strip.

8 Claims, 2 Drawing Figures

VACUUM CLEANER FOR PROFESSIONAL AND HOUSEHOLD PURPOSES

The present invention concerns a vacuum cleaner for professional and household purposes, with actuating elements for introduction of the individual apparatus functions, for instance for turning on and off the blower motor, for rewinding the power supply cord into the housing interior, and for changing the suction capacity. The actuating elements are capable of being actuated by foot.

It is known with vacuum cleaners to arrange the actuating elements for introducing the individual apparatus functions on the upper side of the housing. Disadvantageous with this arrangement having actuating elements actuated predominantly with a foot is that such actuating elements easily collect dirt and dust. The surroundings and environment of the actuating elements are very quickly scratched and made dirty by the manner of arrangement thereof, and by the frequently very small dimensions thereof. The foot actuation is preferred to hand or manual actuation, since with the latter is is necessary to bend or stoop over to the vacuum cleaner. Additionally, the springs which reset the actuating elements mostly are very hard and stiff, and are not well suited for a hand or manual actuation.

A further disadvantage of the actuating elements arranged on the apparatus upper side results from the relatively high position thereof over the floor surface. The individual operating the vacuum cleaner is required to lift the foot for actuation of the pedals, whereby especially older individuals can lose their balance and danger of a fall exists. Additionally, even when the vacuum cleaner is not being used, for instance during storage, there is the possibility that unintended pressing of the switch for the blower motor might occur and for this reason the blower motor then already begins to run when the power supply connection is established during preparation for utilization of the vacuum cleaner.

It is therefore an object of the present invention to embody the vacuum cleaner in such a manner that a more comfortable foot control or operation of the actuating elements is possible without any scratches resulting upon the upper surface of the vacuum cleaner housing. Simultaneously, the actuating elements are to be so arranged that an undesired actuation, primarily other than during use of the vacuum cleaner, is substantially precluded.

These and other objects and advantages of the present invention will appear more clearly from the following specification in connection with the accompanying drawings, in which.

Figure 1:
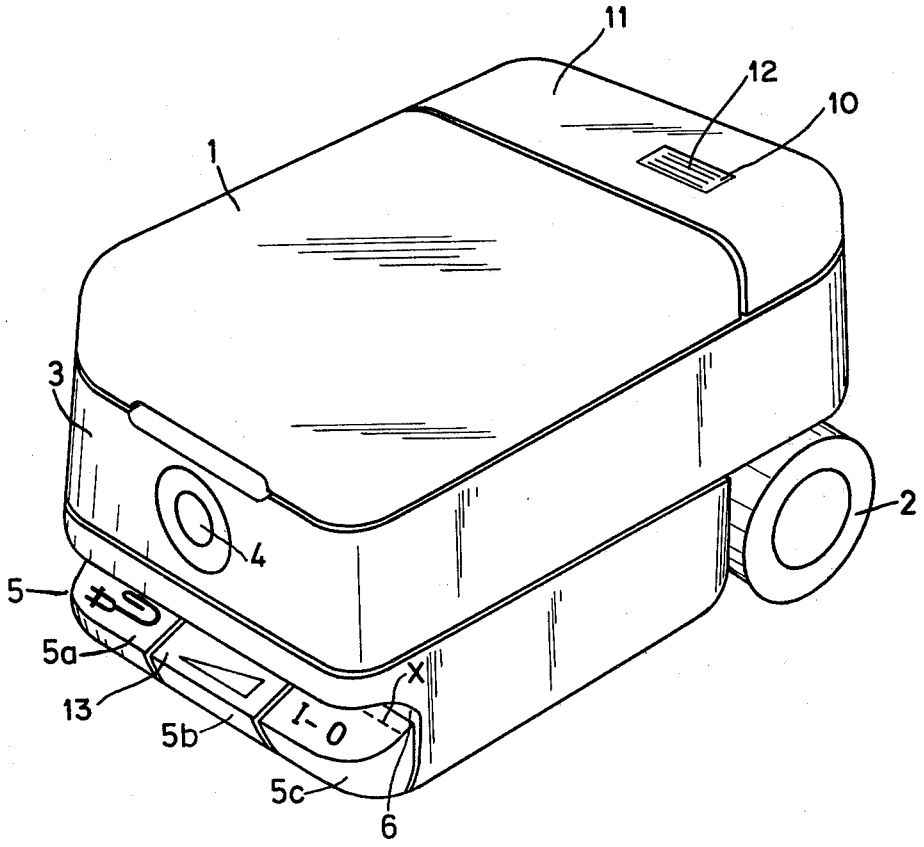
FIG. 1 is a view of the vacuum cleaner of the present invention.

The vacuum cleaner of the present invention is characterized primarily in that the actuating elements are combined in the form of a pedal strip, and are arranged in a lower part of an end face.

With this arrangement, the distance between the upper edge of the floor and the actuating elements amounts to the minimum possible distance, whereby during operation, the foot only needs to be lifted slightly.

The pedal strip is arranged upon the suction-side end face of the vacuum cleaner. The pedal strip also is capable of being arranged below the opening for the suction hose. The pedal strip extends over the width of the side or end face, and forms the lower termination or end thereof. The pedal strip lies within the outer contour of the apparatus housing. The pedal strip is rotatably journalled to turn about its axis parallel to the end face. A free space may be arranged above the pedal strip for introduction of the foot or tip of the shoe. The upper surface of the pedal strip may be inclined toward the front. In addition, the pedal strip may be subdivided into separately actuatable individual pedals. The pedal which changes the suction capacity of the motor blower may be coupled with a device for indicating the adjusted suction capacity. The alteration of the suction capacity is capable of being carried out in steps or in a continuous manner. The pedal strip is also capable of being embodied as a single integral piece, in which case the contacts for actuation are arranged in the region of the outer ends of the single-piece pedal strip.

Referring now to the drawings in detail, the vacuum cleaner 1 is journalled upon wheels 2 and rollers 7 for easier movement thereof over the floor 8. Upon that end face 3 located across from the wheels 2, there is located an opening 4 serving for connection of the suction hose. Below the opening 4 there is installed a pedal strip 5. This pedal strip 5 is arranged at a nominal height above the floor, and is rotatably journalled to turn about its axis x parallel to the end face of the vacuum cleaner 1.

By arranging the pedal strip on the suction-side end face, there is brought about a considerable improvement and there is attained an easier operation and control with respect to the power supply line 9 compared with the arrangement on the other end face. The operating individual is always found on the suction-side end face, yet previously, however, for control or operation had to change over to the other end face or side.

As is apparent from FIG. 1, the pedal strip 5 is subdivided into the individual pedals 5*a*, 5*b*, 5*c* of which each individual pedal can be actuated independently of the other pedals. The individual pedals 5*a*, 5*b* and 5*c* have symbols marked thereon describing the function thereof. The right pedal 5*c* serves for turning on and off the blower motor. By short or brief pressing down of the pedal 5*c*, the motor is turned on, and by once again pressing down the same pedal 5*c*, the motor is turned off again. The last pedal 5*a* serves for rewinding the power supply line 9 and installed within the apparatus housing. This line 9 is withdrawn or pulled out manually from the vacuum cleaner housing for use of the vacuum cleaner 1, whereby the power supply line 9 unwinds or rolls off from a conduit drum rotatably journalled in the housing interior, and in doing so a rewind spring is tensioned in a known manner. The power supply line 9 is arrested in every suitable withdrawn length be a rewind latch or block. After use of the vacuum cleaner 1, by pressing down the pedal 5*a* provided for releasing the rewind latch, the rewind latch or block is released so that the power supply line 9 is rewound upon the conduit drum under the effect of the rewind spring, and returns again to the interior of the vacuum cleaner housing 1. After operation of this rewinding procedure, the pressed-down pedal 5*a* is again released.

For changing the suction capacity of the vacuum cleaner 1, there can be used both mechanical and also electrical elements. The mechanical elements serving for changing the suction capacity are preferably valves or shifters or slides which uncover or close side air openings having different cross sections, so that the operating air flow enters entirely or only partially through the suction tool or device. The electrical elements serving for suction capacity change operate to change the speed of the blower motor by introducing electrical switching procedures which are effective upon the motor blower. By pressing down the pedal 5*b* arranged in the middle between both outer pedal segments 5*a* and 5*c*, such switching procedures are introduced in steps or in a stepless manner (basically continuously). The switching procedure can be changed under such circumstances in small steps, for instance when a pawl, detent or ratchet is coupled with the pedal 5*b*, so that with every pedal stroke a step shifts again, or with a continuous electrical switching device which carries out the switching procedure slowly so long as the pedal 5*b* is pressed down.

The possibilities of using the subdivided pedal strip 5 is not restricted to the described functions or embodiments. For example, as a further function the pedal strip can also make provision for carrying out a further function including opening of the space or chamber receiving the dust filter for changing of the dust filter contained therein, or the pedal strip can be restricted or limited to fewer functions. The pedal 5*b* changing the suction capacity of the motor blower additionally is coupled with an indicator device 10 located in a rear region 11 of the housing and which preferably permits recognition of gradients or surface markings or lines 12 representing the suction capacity set or adjusted for the vacuum cleaner 1.

If only two functions are to be attributed to the pedal strip 5, then the pedal strip can be embodied in a single piece in an integral manner. Under such circumstances, the contacts for actuation are arranged in the region of the outer ends of the pedal strip 5. The particular function is triggered or brought about only by a pivot or tilting movement of the corresponding pedal end, whereby the other end of the pedal strip 5 changes its position only very little or not at all.

Figure 2:
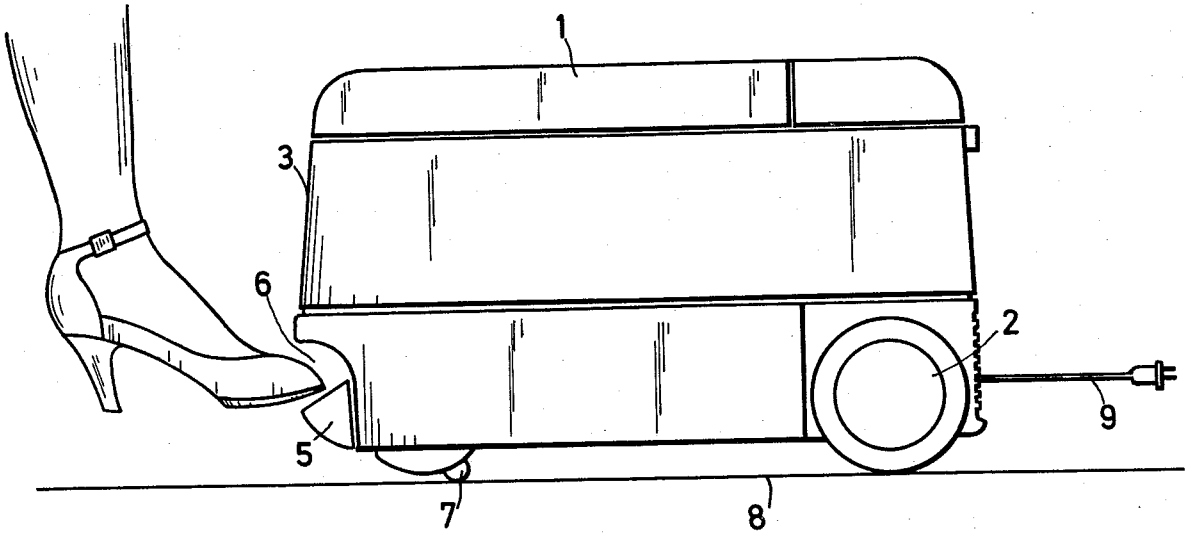
FIG. 2 is a side view of the vacuum cleaner of FIG. 1.

Actuation of the individual pedals 5*a*, 5*b* and 5*c* occurs with the tip of the foot, as illustrated in FIG. 2. For actuation of the pedals 5*a*, 5*b* and 5*c* with the tip of the foot, there is arranged above the pedal strip a free chamber or space 6 for introduction of the foot tip or shoe tip to press down the pedals 5*a*, 5*b*, 5*c*. In order to make the actuation even more easy, and to facilitate operation and control of the vacuum cleaner, the upper surface 13 of the pedal strip 5 can be embodied having an incline toward the front.

It is extremely advantageous, as recognizable from FIGS. 1 and 2, that the pedal strip 5 be located within the confines of the outer contour of the apparatus housing. The pedal strip 5 extends over the width of the end face 3, and forms the lower edge or termination thereof.

The present invention is, of course, in no way restricted to the specific disclosure of the specification and drawings, but also encompasses any modifications within the scope of the appended claims.

What I claim is:

1. A vacuum cleaner for professional and household purposes, which comprises:

a housing; and actuating elements operatively connected to said housing for initiating individual functions of said vacuum cleaner, said actuating elements being adapted to be actuated by foot and being combined in the form of a pedal strip arranged in the lower part of one side of said vacuum cleaner housing;

said pedal strip being arranged on the suction side of said vacuum cleaner housing;

said suction side including an opening for a suction hose, said pedal strip being arranged below said opening;

said pedal strip extending over the width of said side, and forming the lower end thereof;

said pedal strip lying within the outer contour of said housing;

said housing including a free space above said pedal strip for the introduction of a foot, a motor blower, one of said elements being a pedal for changing the suction capacity of said motor blower, and a device coupled with said last mentioned pedal for indicating the adjusted suction capacity.

2. A vacuum cleaner according to claim 1, in which the upper surface of said pedal strip is inclined toward the front away from said opening.

3. A vacuum cleaner according to claim 1, in which said pedal strip is subdivided into separately actuatable individual pedals.

4. A vacuum cleaner according to claim 1, in which said pedal is adapted to effect said suction capacity change in steps.

5. A vacuum cleaner according to claim 1, in which said pedal is adapted to effect said suction capacity change continuously.

6. A vacuum cleaner for professional and household purposes, which comprises:

a housing; and actuating elements operatively connected to said housing for initiating individual functions to said vacuum cleaner, said actuating elements being adapted to be actuated by foot and being combined in the form of a pedal strip arranged in the lower part of one side of said vacuum cleaner housing;

said pedal strip being arranged on the suction side of said vacuum cleaner housing;

said suction side including an opening for a suction hose, said pedal strip being arranged below said opening;

said pedal strip extending over the width of said side, and forming the lower end thereof;

said pedal strip lying within the outer contour of said housing;

said housing including a free space above said pedal strip for the introduction of a foot, said pedal strip being a single integral piece.

7. A vacuum cleaner according to claim 6, which includes actuation contacts arranged in the outer, oppositely arranged, ends of said single-piece pedal strip.

8. A vacuum cleaner according to claim 6, in which the upper surface of said pedal strip is inclined toward the front away from said opening.

* * * * *